US011261558B2

(12) United States Patent
Eiselt et al.

(10) Patent No.: US 11,261,558 B2
(45) Date of Patent: Mar. 1, 2022

(54) WASHING MACHINE RECEPTACLE, WASHING MACHINE AND METHOD FOR OPERATING A WASHING MACHINE

(71) Applicant: E.G.O. Elektro-Geraetebau GmbH, Oberderdingen (DE)

(72) Inventors: Juergen Eiselt, Illertissen (DE); Uwe Schaumann, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 31 days.

(21) Appl. No.: 16/650,020

(22) PCT Filed: Oct. 25, 2017

(86) PCT No.: PCT/EP2017/077358
§ 371 (c)(1),
(2) Date: Mar. 24, 2020

(87) PCT Pub. No.: WO2019/081014
PCT Pub. Date: May 2, 2019

(65) Prior Publication Data

US 2020/0277720 A1 Sep. 3, 2020

(51) Int. Cl.
*D06F 39/02* (2006.01)
*D06F 34/22* (2020.01)
(Continued)

(52) U.S. Cl.
CPC ..... *D06F 39/02* (2013.01); *D06F 33/52* (2020.02); *D06F 34/22* (2020.02); *D06F 25/00* (2013.01);
(Continued)

(58) Field of Classification Search
CPC ..... D06F 39/02
See application file for complete search history.

(56) References Cited

U.S. PATENT DOCUMENTS 6,349,440 B1 2/2002 Amberg et al.
6,434,977 B1 8/2002 Hepke et al.
2012/0247158 A1 10/2012 Ditze et al.

FOREIGN PATENT DOCUMENTS

DE 10-2006-038341 A1 2/2008
DE 10-2015-205382 A1 9/2016
(Continued)

OTHER PUBLICATIONS

International Searching Authority, International Search Report and Written Opinion for International Application No. PCT/EP2017/077358, dated Jun. 25, 2018, (12 pages), European Patent Office, Rijswijk, The Netherlands.

*Primary Examiner* — Jason Y Ko
(74) *Attorney, Agent, or Firm* — Alston & Bird LLP

(57) ABSTRACT

A washing machine drawer (50) in a washing machine (11) has a drawer body (51) with several chambers including chambers (63) for filling in detergents or additives for a washing process, sensor means (71, 76, 80) in the receptacle for analyzing water transported to the sensor means and a receptacle communication module (56) for a data connection to the outside. A control device (40) of the washing machine is communicating with the receptacle communication module (56) to receive data about analysis results from the sensors for adapting a washing process. The drawer (50) may be exchangeable to provide the washing machine with more and up to date features. The drawer (50) may also have a receptacle control (54) provided with a powerful controller to overtake some functions of the washing machine (11) besides controlling the sensor means.

29 Claims, 3 Drawing Sheets

(51) Int. Cl.

| | |
|---|---|
| ***D06F 33/52*** | (2020.01) |
| *D06F 39/08* | (2006.01) |
| *D06F 34/04* | (2020.01) |
| *D06F 34/05* | (2020.01) |
| *D06F 34/32* | (2020.01) |
| *D06F 25/00* | (2006.01) |

(52) U.S. Cl.
CPC ..... *D06F 34/04* (2020.02); *D06F 34/05* (2020.02); *D06F 34/32* (2020.02); *D06F 39/083* (2013.01)

(56) References Cited

FOREIGN PATENT DOCUMENTS

| | | | |
|---|---|---|---|
| DE | 10-2015-107976 | A1 | 11/2016 |
| EP | 1688529 | A1 | 8/2006 |
| EP | 2860295 | A1 | 4/2015 |
| EP | 3150757 | A1 | 4/2017 |
| WO | WO-2012/114269 | A1 | 8/2012 |

WASHING MACHINE RECEPTACLE, WASHING MACHINE AND METHOD FOR OPERATING A WASHING MACHINE

CROSS REFERENCE TO RELATED APPLICATIONS

This application is a National Stage Application, filed under 35 U.S.C. 371, of International Application No. PCT/EP2017/077358, filed Oct. 25, 2017; the contents of which is hereby incorporated by reference in its entirety.

BACKGROUND

Related Field

The invention is directed to washing machine receptacle, a washing machine for use with such a receptacle and also comprising such a receptacle and a method for operating a washing machine.

It is theoretically known to control an electrical household appliance, for example a washing machine, with some kind of remote control, for example via the Internet. This can provide for not only a remote controlling of the operation of the washing machine, but also for various control methods with some control features that may be in addition to standard functions of the washing machine.

BRIEF SUMMARY

It is an object of the invention to provide a washing machine receptacle, a washing machine and a corresponding method for operating a washing machine to overcome problems of the prior art, wherein preferably a better implementation of functions into a washing machine is possible, especially for sensing functions, and that in particular can be implemented and used without major inconvenience for a user.

This object is solved by a washing machine receptacle with the features of claim 1, a corresponding washing machine with the features of claim 21 and a method with the features of claim 27. Advantageous and preferred configurations of the invention are the subject of the further claims and are explained in more detail below. In this case, some of the features are described only for the washing machine receptacle, only for the washing machine or only for the corresponding method for operating a washing machine. However, regardless of this, they are intended to be able to apply by themselves for the washing machine receptacle and for the washing machine and for the method independently of one another. The invention is also directed to a combined washing machine and dryer combined in one, which in the context of this invention is also regarded as a washing machine. The wording of the claims is made to the content of the description by means of express reference.

A washing machine receptacle according to the invention has a receptacle body that has several chambers, wherein chambers for filling in detergents or additives for a washing process in the washing machine are included. Other chambers may preferably be provided in addition, for example for sensing or analysis functions. Sensor means are provided in the receptacle for analyzing water transported to them, wherein the sensor means preferably are in a sensor chamber mentioned before. Also a receptacle communication module for a data connection to the outside of the receptacle and/or the washing machine is provided in or on the receptacle.

This allows for a communication and data connection or data transfer, for example from the sensor means, out of the receptacle.

The receptacle communication module for the data connection to the outside may in one embodiment be designed wireless, preferably being selected from the group of: inductive, RF, NFC, BT, BTLE, GPRS, WLAN and optical data transmission. This allows for easy connectivity, especially in case where the receptacle is movable inside the washing machine, for example partly retractable, or even completely retractable or removable out of the washing machine. It also allows for a wireless data communication to a WLAN network in a household.

In another embodiment of the washing machine receptacle, the receptacle communication module for the data connection to the outside is designed to be with a direct electrical connection having electrical contacts. This may in particular be a direct electrical connection to the washing machine, preferably with a cable connection having a flexible cable provided in the washing machine and having an electrical plug at its end. This may be for a connection to a mating plug in the washing machine or in the washing machine receptacle, in particular at a back end of the washing machine receptacle. Such a direct electrical connection may be to a control device of the washing machine, a motor control of the drive motor and/or to a power supply of the washing machine from a mains source.

The receptacle may be provided with a receptacle control device having a controller or a processor for controlling the sensor means on the one hand. On the other hand, data of the sensor means may be processed, which means that this data can be evaluated partially or completely, for example to determine whether microfibers are present in the water. Another option is to control also the washing machine itself at least partially, preferably essentially. Such a control may be established depending on the sensor data, or because the controller in the receptacle is very powerful. This allows for more options on how the intelligence or control power is distributed in such a washing machine according to the invention, which will be explained in detail later on.

In one embodiment of the invention, the receptacle control device can be provided with program sequences, which are stored in a receptacle data storage. The receptacle data storage may be separate from the receptacle controller, wherein in particular the receptacle data storage can be detachable from the receptacle. This allows for easy replacement or replenishment of data or programs for further functionalities or the like.

The receptacle control device may be provided in a front part or in a back part of the receptacle, preferably in front of or behind any chambers in the receptacle that are to be filled with water in regular operation of the washing machine. Alternatively, the receptacle control may also be provided on a lateral side or underside. A receptacle communication module may also be arranged together with the receptacle control device, eventually on the same mainboard or circuit board, respectively. A receptacle communication module may also comprise any antenna needed for the communication.

The receptacle preferably has at least one chamber body with all the chambers being formed or contained therein. It may be made from synthetic material, in particular cast in one piece in one step for better handling and being watertight. The chamber body can be mounted together with further parts of the receptacle, wherein the receptacle control device is advantageously provided outside of this chamber body. It is even more preferred to make the receptacle as a construction unit. This allows for easier handling, also as a regular washing machine receptacle with loading detergents or the like. It also allows for easier replacement.

The receptacle control device preferably has a sensor controller of its own for analyzing and/or processing data of the sensor means, wherein preferably this may be separate from a controller for controlling the washing machine or a controller of a motor control. Such a controller in the washing machine apart from the receptacle may be provided for basic or core functions of the washing machine.

In an embodiment of the invention, either such a sensor controller or a receptacle control device mentioned before may be connected to an external database for supporting the analyzing process. Also a reporting of information from the analyzing process of the sensor means may be supported. Such an external database may be a database in the internet or in a cloud server connected to via internet. The information may be about water quality of fresh water being introduced into the receptacle from outside or about microfibers or other particles detected in the water by the sensor means. Any sensor signals or information can be sent to such a database without being analyzed by the receptacle control device itself to use a bigger and, especially, more up to date information basis.

In a preferred embodiment, operating elements are provided on the receptacle, which may be at least operating elements for controlling or influencing an operation of functional units of the receptacle, in particular sensor means or filtering means as functional units. The operating elements may also be in the form of a touch screen, thus combining input and output. Even a control of the washing machine itself regarding the washing process, for example for inputting a washing temperature or a special program, may take place via these operating elements in one embodiment of the invention. It is even possible to provide operating elements only on the receptacle with the exception of only a main switch for the washing machine being provided outside of the receptacle or separate from the receptacle and on the washing machine for safety reasons, preferably at a location as in the prior art.

It is also preferred to provide display means on the receptacle, wherein preferably the display means may comprise a touch sensitive display or touch screen including touch sensors as operating elements, thus combining input and output in one device and at one location.

In a further first basic embodiment of the invention, the receptacle is provided at least with components of a smartphone, a tablet computer or a similar mobile device, preferably at least a display and a main control board. Also a camera and/or a communication module may be provided, may be also a rechargeable battery. This means that only parts or components of such a mobile device may be used in the receptacle. In particular these components may be connected to a receptacle control device as mentioned before or to an external WLAN network. The components of the smartphone are arranged in the receptacle such that a display of the smartphone may be directly visible to the outside, preferably by being arranged at a front side of the receptacle. A further protective screen may be placed above it but need not. These components may then be fully integrated into the receptacle.

In a second basic embodiment of the invention, the receptacle is provided with an integral smartphone, tablet computer or similar mobile device. This means that the whole mobile device is used and functionally integrated into the receptacle. This allows for easier construction with very little need for space. Also such an integral smartphone may be arranged in the receptacle such that its display is visible to the outside as explained before, preferably by being arranged at a front side of the receptacle.

In a further preferred embodiment, a camera or an optical sensor is provided as a component of a smartphone or in the integral smartphone or mobile device, respectively. The camera or the optical sensor can be directed into the receptacle and into a chamber in the receptacle body, preferably for an optical analysis in the chamber. Accordingly, it is preferably a sensor chamber. Optical guide means can be provided to guide light beams between the chamber and the camera or optical sensor. This may also be done using an IR spectrum, which can also be at least partially analyzed by a modern camera in the mobile device.

The components of the mobile device or the integral smartphone or mobile device can be connected to a receptacle control device if such is present. However, preferably, the controller as a part of the mobile device or of the integral mobile device mentioned before can itself be such a receptacle control device. Nowadays, controllers of such mobile devices are very powerful, which is sufficient for any possible need in a receptacle according to the invention. Then no other controller or the like needs to be provided in the receptacle, except if any of the sensors has a special controller or microcontroller integrated. Then operating elements, preferably a touch screen, of the partial or the integral mobile device may be the receptacle operating elements described before. A controller of such a mobile device may also be used for the whole washing machine as explained before. In one embodiment, only a motor control may have a special controller for powering the drive motor.

At least one sensor chamber with the sensor means can preferably be provided in the receptacle for being filled with water from the drum of the washing machine or with fresh water for being analyzed by the sensor means. The at least one sensor chamber may have a controllable valve for storing of water or draining of water or of residue from the water out of the sensor chamber and, finally, out of the receptacle. In particular there may be a connection into the drum, alternatively into a sewage line out of the washing machine. Storing water in a sensor chamber may serve for a longer and, consequently, thus more thorough analysis of the water. More preferably, several separate sensor chambers are provided in the washing machine receptacle. They may be in serial arrangement and/or in parallel arrangement. This depends on the space available and on a needed sequence of sensors.

Furthermore, a pre-filter can be provided before the at least one sensor chamber for filtering out larger particles or dirt from the water before entering the sensor chamber. This serves for keeping the sensor clean for a better analysis.

The sensor for analyzing water from the drum or fresh water may be selected from the group of pH-sensors, temperature sensors, Bio sensors for bacteriological pollution, optical sensors, opacimeter sensors, spectrometer sensors, color change indicator sensors, tenside sensors, sedimentation analysis sensors, or any combination of these.

In addition, the sensor means may be provided with mechanical actors for pressing or squeezing agglomerated particles from the water that shall be analyzed. Such is known from general sensor technology.

At least one sensor means may be arranged in the sensor chamber close to a sensor chamber bottom or on a sensor chamber bottom itself to be covered by water in the sensor chamber in any way. This allows for a longer analysis. At least one sensor means may be arranged above the water in the sensor chamber or at its top cover to be separate from water in the sensor chamber or water entering the sensor chamber. So this sensor can stay dry or at least is not influenced by water.

At least one sensor chamber may be provided with means for cleaning by flushing with fresh water, for example to remove dirt or particles potentially distorting the sensor means or a sensor thereof. After this, the water to be analyzed can be filled in.

In a further embodiment of the invention, an activating means can be provided in the receptacle for treating special detergents or special additives for a special washing process or step in a washing process. These may include washing active substances, wherein these special detergents or special additives can be activated by a mechanical treatment, a chemical treatment, a heat activation, a microwave radiation or a UV radiation. The receptacle may then be provided with a special detergents chamber for these special detergents or special additives to be stored in the receptacle, where it is convenient for a user. The activating means then can be provided in or next to this special detergents chamber for a quick and direct activation.

Furthermore, a processing chamber with at least one processing means can be provided in the receptacle. Such a processing chamber may be in a serial arrangement before a sensor chamber, so that water can be processed in there being later analyzed in the sensor chamber. Such a processing may serve for a better analysis by the sensor means.

As mentioned before, the receptacle can advantageously be at least partly movable or retractable out of a housing of the washing machine, wherein preferably the receptacle is a drawer. It can even be possible that a drawer according to the invention may be used in a conventional washing machine if it can be arranged that a machine control device can be provided with a communication module to be connected with the receptacle control device.

In a preferred embodiment, the receptacle is a construction unit in one piece or an integral unit. It may also be at least water tight, preferably to protect any receptacle control device or communication module.

Such a receptacle may be constructed with at least three separate chambers, their possible use has been explained before. A filtering means may be provided in a filtering chamber, for example for filtering out fibers or, preferably, microfibers from the water for ecological reasons. At least one sensor chamber with a sensor means should be provided. Finally, an outlet out of the receptacle or a drainage of the receptacle is needed. There may advantageously be provided at least one detergent chamber for filling in detergents or additives for the regular washing process as a basic function of the drawer.

A mixing chamber can be provided and arranged before the sensor chamber, preferably in the direction of water flow in the receptacle. Such a mixing chamber may be connected to a supply of additives to be mixed with water. These additives may serve for a better analysis of the water in the sensor chamber. A valve can be provided on the supply of additives for exactly dosing these additives into the water in the mixing chamber.

The receptacle may have at least one chamber body with all chambers being formed or contained in such a chamber body. The chamber body can be connected to or provided with at least one detergent chamber mentioned before for detergents or additives for the washing process, preferably at least two or three detergent chambers for detergents or additives as is provided in conventional washing machine drawers.

In the chamber body mounting means may be provided for mounting additional functional units in the chamber body. Such may be for example additional sensor means, additional additive depots or additional filtering means. In particular the mounting means are formed for mounting the functional units by plugging in, for example as sliding rails or the like.

Some of the chambers in the chamber body may all be arranged in serial order one after the other. So water can flow through one after the other. In addition, at least one chamber can be provided on one lateral side of this serial order of chambers. It may be provided that the chambers for detergents and regular additives for the washing process may be in one line as in a conventional drawer, whereas the chambers for the sensor means and for the filtering means or for processing water may be provided in parallel.

Filtering means for water, preferably from a water circulation in the washing machine, can be provided in the receptacle, for example for filtering out microfibers. A water circulation is leading with a branched-off duct to the receptacle, preferably with water from the drum or from a sump underneath the drum, wherein in particular the filtering means may be accessible via the receptacle or after extracting of the receptacle. This serves for cleaning or replacing them.

The filtering means can be specially designed for filtering out microfibers from the water in the water circulation exiting the drum via the water circulation mentioned before. Preferably the filtering means may have a variable or adjustable aperture size for filtering microfibers of different size in different regions of filtering surfaces. Alternatively, a filtering may take place in different filtering steps.

In addition to the filtering means for the microfibers in the water circulation described before, a pre-filter may be provided before them. This may preferably be a pre-filter for articles with a size bigger than 2 mm in one direction, preferably for fluff or lint, as is known in some conventional washing machines. It may in particular be that the filtering means for the microfibers are arranged close to the pre-filter, for example with a distance of less than 10 cm. It is also possible to arrange the pre-filter directly behind a water inlet into the receptacle so that partially cleaned water will enter the receptacle.

The filtering means do in one embodiment have a collecting chamber of their own for collecting the microfibers or filtrate transported to them from the filtering means. The collecting chamber may be connected to the filtering means and is preferably located at an end of the filtering means and below them. The collecting chamber may be accessible from outside the washing machine receptacle after drawing the receptacle out of the machine. This allows for easier cleaning of the filtering means.

A filter cleaning device can be provided for cleaning the filtering means from germs and microbes, for example with a heating element heat or a UV light source. These are conventional measures. Such a cleaning device may also serve for further purposes as is explained later in detail.

In one embodiment, the washing machine receptacle can be provided with an electrical generator having a turbine driven by water flowing through the receptacle. Such a turbine can be arranged behind a water inlet into the receptacle, in particular before a chamber for detergents, additives, sensor means or filtering means. Even if not much electrical energy is generated, this may in some cases be sufficient to power a receptacle control. Preferably, an independent and/or replaceable energy source is provided in the receptacle, for example a battery or an accumulator. This serves for a better and more reliable energy supply.

The receptacle can also be provided with a wireless connection to an energy source such as with an inductive energy transfer between a receiving module in the receptacle and a charging module in the washing machine close to the receptacle when it is inserted into a working position.

As has been explained before, the receptacle can be provided with a direct electrical connection to the washing machine such as with a cable connection. A flexible cable can be provided in the washing machine having an electrical plug at its end for connection to a mating plug in the receptacle, in particular at a back end of the receptacle in the washing machine. This serves for easier plugging in or out.

A washing machine according to the invention for use with a washing machine receptacle as described before, especially incorporated in this washing machine, has a housing, a drum in a drum housing for conducting a washing process therein and a sump located underneath the drum or underneath the drum housing for collecting water exiting the drum as in a conventional washing machine. A water circulation and a circulation pump for circulating water in the water circulation with the help of pipes for connecting these components is provided. This is also mainly according to a known washing machine. A dispensing system is provided being configured to supply to the drum detergents, additives or chemicals for the washing process, wherein such a dispensing system may have the washing machine receptacle included therein. This is in case where water circulating from the drum at first passes through the receptacle. A separate water duct is provided for water from the drum to be transported into the dispensing system. A machine side communication module is provided in the washing machine itself for communication with the receptacle or with a receptacle side communication module, respectively.

The washing machine may have a control device of its own being adapted for controlling water heating and drum rotation, as explained before. This machine control device may have the machine side communication module for communicating with the receptacle communication module. There may also be a receptacle control device in the receptacle being connected to with the receptacle communication module as explained before. This has been explained before in detail. It can be provided that the washing machine has no other control device than one in the machine side communication module for communication with the receptacle communication module or in a motor control, for example an inverter. This means that the intelligence is mainly placed into the receptacle control device. As has been explained before, the intelligence can be diverted in different ways between the receptacle control device and the machine control device.

A valve may be placed behind the circulation pump, wherein its valve outlet is connected to the separate water duct to the dispensing system. It may also be connected to the washing machine receptacle therein. Preferably an outlet of the separate water duct is located next to but separate from a fresh water inlet into the receptacle from outside the washing machine.

A siphon can be provided beneath the dispensing system and/or the washing machine receptacle therein. The siphon may lead into a water duct out of or away from the dispensing system and the washing machine receptacle therein, preferably leading back to the drum. The siphon may be arranged and constructed such that it shuts off a chamber in the receptacle for water to be stored therein with a certain water level. It may also be possible that the siphon can be activated and opened by filling more water into the chamber with the result of the chamber being completely drained through the siphon after exceeding a certain water level. This may help to save the effort for a separate valve.

The receptacle can be located in the washing machine at a higher level than a center point of the drum, preferably higher than the whole drum. In particular it can be located to the left side or to the right side of the drum in an uppermost area of the housing of the washing machine as is conventional.

The receptacle control device may also be connected to a motor control for a drive motor of the drum, the motor control being located in the washing machine. It may have a conventional inverter or energy converter as is known in the art. Apart from a controller or microcontroller in the motor control, the at least one controller in the receptacle control device can be the only controller in the complete washing machine. The receptacle control device may send commands to the motor control, preferably about a rotation speed of drum for best adapting a washing process to the situation given and detected by the sensor means in the receptacle, which the receptacle control device has evaluated.

In addition, the receptacle control device may also send control signal or commands to a heating control or to a power converter for the heater for the water in the drum. Also this can be to adapt the washing process best as has been described before for the motor control.

In a method according to the invention for operating a washing machine as described before, the water transported or circulated in the washing machine to the receptacle is analyzed by the sensor means being provided in the receptacle. This means that water has to be brought to the receptacle or has to at first enter the washing machine through the receptacle.

For filtering the water in the filtering means in the receptacle, it may be provided that in certain time intervals, in particular corresponding to a step-wise reduction of an aperture size of the filtering means as described above, water to be filtered is passed over a different area of filtering surfaces of the filtering means. This serves for depositing filtered out microfibers on different areas of the filtering surfaces. They may then be easily collected.

It is also possible to reduce an aperture size of the filtering means continuously or in steps during a filtering process when water circulating in the water circulation flows over or through the filtering means.

It is further possible to provide for enzymes or washing active substances being non-active with water in a storage state, preferably in the receptacle. The enzymes or washing active substances may be introduced into the receptacle or into a chamber and are then activated to change into an activated state, wherein the activation can include at least one of thermal, mechanical, chemical, light or UV light, respectively, activation. They are subsequently, preferably in an activated state, brought into the drum to the washing process to take effect there.

The washing machine may be connected to other functional devices in a house such as a water pump of the house, a boiler or a hot water reservoir, a dryer or a dishwasher, preferably via the receptacle communication module. An operation of these functional devices may be coordinated for example as to use the least electrical energy at the same time, as to have the right or sufficient water pressure, or the like. A coordination may be made externally, for example by a cloud server, or by the receptacle control device. For such an action as well as for any other action with support or aid from an external source, action information may be received from the cloud to control a function unit of the washing machine. Alternatively or in addition information can be forwarded from the washing machine to the cloud. The cloud or cloud server, respectively, can be configured to communicate with a plurality of home appliances and/or to provide to the washing machine energy cost information as action information and/or to provide water quality information as action information and/or to provide advertisement information regarding the washing machine. This provides for much more optional information than in a conventional household appliance, especially a washing machine.

A connection to the internet or to the cloud server may be made by the mobile device. Data can be transmitted into the washing machine concerning operating parameters of the washing machine. In a preferred embodiment, a mobile device being partly or completely integrated into the receptacle may be essentially the only control device of the washing machine. It may in any case use the data from the internet or from the cloud server to generate control instructions for the washing machine or its functional units, respectively.

For operating the washing machine according to the invention, sensor information may be transmitted from the washing machine receptacle to the internet or to the cloud server. There this sensor information is being processed and evaluated, wherein respective information, the evaluation result or corresponding command signals are sent back to the washing machine receptacle. They may then be further used by the receptacle control device to partly or completely control the washing process of the washing machine.

Such a method can comprise at least one of the following steps:

- choosing activating times depending on energy costs,
- selecting a washing temperature depending on detergent characteristics,
- dosing a softener depending on characteristics of the softener,
- dosing a softening agent depending on characteristics of the softening agent or depending on water data in the location of the appliance,
- determining characteristics of clothes and choosing, depending on the characteristics of clothes, program, temperature and/or spin,
- choosing a rinsing cycle depending on water hardness, and/or
- scheduling a cycle depending on weather conditions.

The control commands or action information may be generated depending on results of one or more of these steps.

Such information may comprise maintenance information which is forwarded by the washing machine to the cloud server, wherein the cloud server is configured to evaluate such maintenance information. It can then provide maintenance advice depending on the maintenance information back to the washing machine or to a user, respectively.

Such a method may simultaneously be used for controlling a plurality of home appliances and/or for collecting data of a plurality of home appliances in a region. This may be up to 50 to 500 or even more household appliances.

These and further features are evident not only from the claims but also from the description and the drawings, the individual features each being implemented by themselves or in multiples in the form of subcombinations for an embodiment of the invention and in different fields and being able to be advantageous and independent protectable embodiments for which protection is claimed here. The division of the application into individual sections and subheadings does not limit the general validity of the statements made thereunder.

BRIEF DESCRIPTION OF THE FIGURES

Exemplary embodiments of the invention are schematically represented in the drawings and will be explained in more detail below. In the drawings.

DETAILED DESCRIPTION OF VARIOUS EMBODIMENTS

Figure 1:
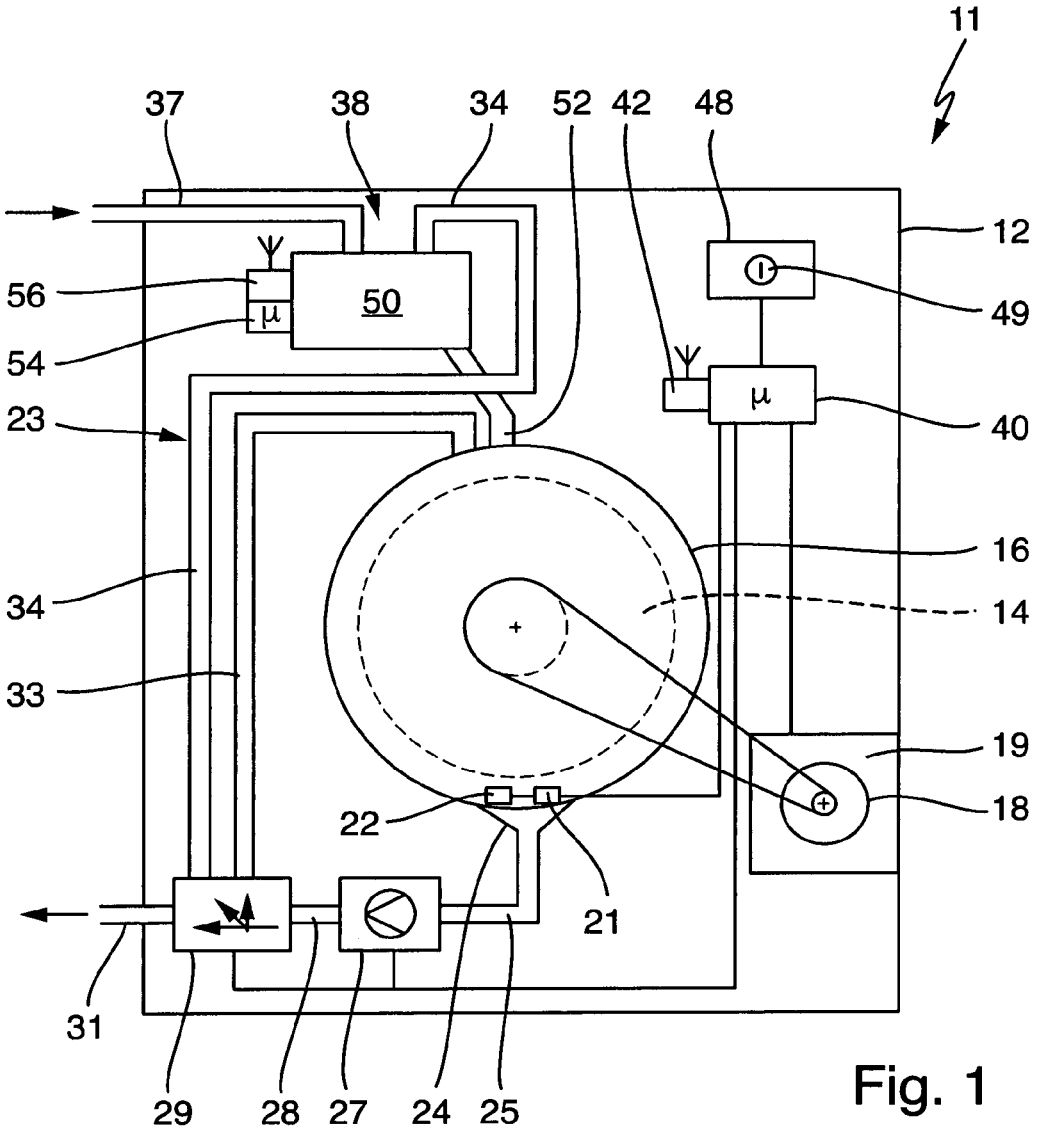
FIG. 1 shows a schematic view of a washing machine according to the invention with a conventional water circulation which, additionally, contains detecting means and a filter for microfibers in a drawer also used for dosing detergents and additives into the washing process.

FIG. 1 represents a schematic view of a washing machine 11 according to the invention. Washing machine 11 has a housing 12 including a drum 14 in a drum housing 16. A drive motor 18 is provided for drum 14 having a motor control 19, preferably integrated with drive means, for example in the form of an energy converter. On the lowest region of drum housing 16 or in a sump 24 underneath leading out of drum housing 16, a heater 21 together with a temperature sensor 22 for controlling operation of the heater 21 to heat up water in the sump 24 are provided. Furthermore, a water circulation 23 is provided which is partly according to the prior art.

From sump 24 a sump pipe 25 leads to a pump 27. This pump 27 corresponds to the usual circulation pump in a conventional washing machine. From an outlet of pump 27, a pump pipe 28 leads to a valve device 29, which is a so-called three-way-valve. In a first position, valve device 29 connects to a sewage line 31 out of the washing machine 11 leading into a sewage of a house or the like. In a second position, valve device 29 is connected to a circulation pipe 33 which leads back to the drum housing 16 such that circulating water enters drum housing 16 from above for participating in the washing process in drum 14.

A third pipe in the form of a filter pipe 34 is provided leading from valve device 29 in its third position to a drawer 50 as a washing machine receptacle as described before. The drawer 50 is detailed later in FIGS. 2 to 8.

Washing machine 11 also has a machine control device 40 that may correspond partly to a conventional control device for a washing machine. Control device 40 is connected to heater 21 and temperature sensor 22, pump 27, valve device 29 and motor control 19. Furthermore, control device 40 is connected to a conventional operating device 48 with operating elements 49 for a user, which could also have any optical signaling means or a display. Other sensors for the direct control or surveillance of the washing process could be provided as well.

Washing machine 11 is provided with a fresh water pipe 37 for delivering fresh water from outside to the washing machine 11 and to a washing process, respectively. This fresh water from fresh water pipe 37 enters a dispensing system 38, which in this case comprises among others the drawer 50 according to the invention, that, apart from the inventive aspects, can also fulfill the functions of a conventional drawer according to the prior art. Drawer 50 being arranged in the upper left area of the washing machine 11 will be described later. From drawer 50, a drawer outlet 52 leads again into drum housing 16 from above. Detergents and/or additives for a washing process are inserted into drawer 50 by a user of washing machine 11. They are flushed with the help of fresh water from a fresh water pipe 37 into drum 14 for the washing process. This corresponds to a conventional washing machine. Fresh water pipe 37 may be provided with several valves that are controlled by control device 40 to deliver fresh water into one of several chambers in drawer 50, which is also known in the art and which will be described later.

Figure 2:
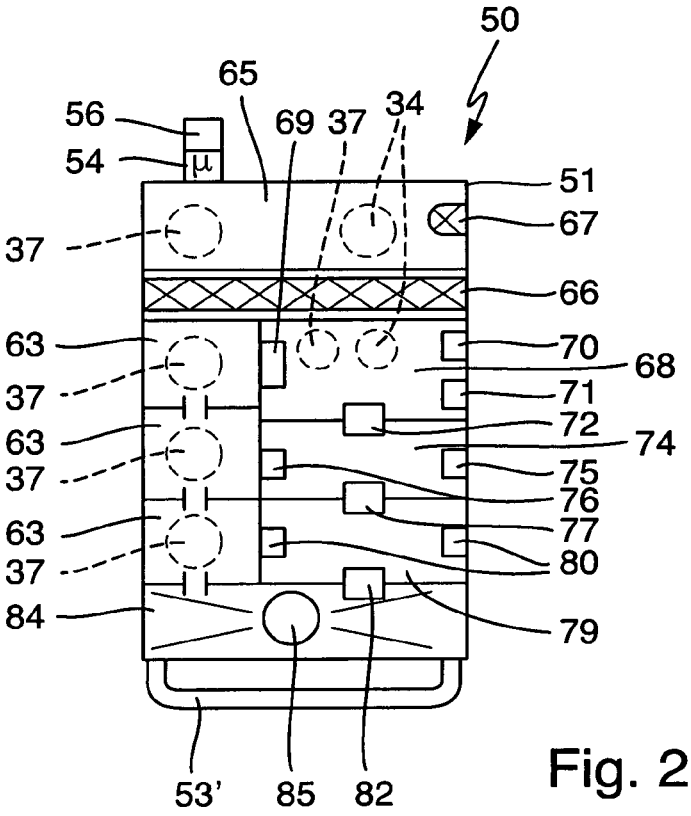
FIG. 2 shows a schematic view from above onto the drawer of FIG. 1 with a filter, several chambers and several sensors.

FIG. 2 schematically shows an exemplary embodiment of drawer 50 having a drawer body 51 in a view from above. In the front part, a grip 53 is provided for extracting drawer 50 out of housing 12. Drawer body 51 is provided with a plurality of chambers and also water inlets. Water inlets are, on the one hand, represented in dashed lines as fresh water inlets 37 in several locations.

On the other hand, filter pipe inlets 34 are also provided in several locations, also represented in dashed lines. Diverting a water flow between these various inlets is not shown here, but can easily be done via valve devices or the like. Especially for fresh water from fresh water pipe 37, valve devices or the like being used in conventional washing machines may preferably be provided. The same applies to water from filter pipe 34, which is circulating water being pumped by circulation pump 27.

In a front left region of drawer 50, three detergent chambers 63 are provided in one row being connected via openings in such a way that water entering one of these chambers flows in any case with the aid of a downward slope not represented here to the foremost detergent chamber 63. From there, finally, the water flows into an outlet chamber 84 having a siphon outlet 85 or the like, which again leads into drawer outlet 52 and back into drum housing 16. The number of detergent chambers 63 could be higher or lower. They can be used for filling in detergents as well as additives like softeners or the like, as is known from conventional washing machines. Each of these detergents and softeners are flushed into the washing process when they are required in a conventional manner.

In the back part of drawer body 51, a filter chamber 65 is provided with two water inlets, namely one from fresh water pipe 37 and one from filter pipe 34. A filter 66 is provided with a filter membrane, which forms a kind of filter outlet from filter chamber 65. Filter 66 with filter membrane can be of any kind as described above, preferably a conventional filter surface being able to filter microfibers with a size of down to 1 μm or 2 μm from water.

To be able to clean filter chamber 65 as well as filter 66 from germs and microbes, at least one UV lamp 67 can be provided. Another such UV lamp or a similar device can be provided on the other side of filter membrane.

Filter 66 can also be provided with any filter cleaning means. Furthermore, filter 66 or its filter membrane, potentially also together with filter chamber 65, may be designed to be removable from drawer 50 to be extracted for emptying its content into the household garbage or the like. Filter 66 with filter membrane may also be a disposable filter for a complete removal together with filtered matter. A new filter may be inserted afterwards for further use of the washing machine 11.

Behind the filter 66, the filtered water enters a reactor chamber 68 being provided with a special additive supply 70, a heater 69 and a sensor 71. Above reactor chamber 68, a fresh water pipe 37 and a filter pipe 34 are represented again in dashed lines to show that filter 66 can somehow be by-passed for direct use of reactor chamber 68 and the following chambers if filter 66 is not or not yet needed or if it is flushed back for cleaning purposes.

The special additives in special additive supply 70 may be special detergents as enzymes or the like, which can be activated by heat from heater 69, or in some other manner. They may be of great use in specific washing procedures depending on the kind of laundry and the kind of pollution on the laundry. Furthermore, such special additives may serve for the purpose of laundry being made up of synthetic fibers reducing an output of microfibers, for example by reducing internal friction in the fabric of the laundry. Even if reactor chamber 68 is not used, circulating water may be introduced directly therein to by-pass filter 66.

A valve 72 may open a water flow from reactor chamber 68 into the next chamber being a processing chamber 74. In processing chamber 74, processing means 75 are arranged on one side, and a sensor 76 is arranged on the other side. The processing means may include a heater or a radiation source, particularly for treating water, contamination in the water or, especially, microfibers or other textile fibers in the water. The sensor 76 may be designed to monitor such a treatment or its results, respectively, for a better control of it. Such a water flow may be achieved as in the detergent chambers by a downward slope in the chambers on the right side.

Through a further valve 77, the water may flow from processing chamber 74 into a detecting chamber 79 in front of it being provided with two sensors 80 and being closed by another valve 82. In detecting chamber 79, the main detecting process for detecting microfibers in the water circulating in washing machine 11 or, respectively, in water circulation 23 takes place. Sensors 80 may be of any kind as described before, preferably they are a sedimentation analysis sensor such that detecting chamber 79 corresponds to a sedimentation chamber as is known in the art for analyzing purposes. For such a sedimentation analysis, water from the water circulation 23 in washing machine 11 may be introduced via filter pipe 34 and open valves 72 and 77 into detecting chamber 79, whereas valve 82 is closed. If detecting chamber 79 is filled up to a certain degree or for a certain time, valve 77 is closed and valve 82 may either be slightly opened to let out some water or, even better, a certain amount of time is let pass until fibers and other matter in the water in detection chamber 79 can sink down as is known in the art. Sensors 80 may then detect in the conventional manner whether microfibers are present at all and, in addition, may try to detect whether the pollution of the circulating water with microfibers is rather low or rather high, in particular when compared to other fibers present in the water and, in consequence, also in detection chamber 79. Sedimentation analysis sensors together with optical sensors, for example IR sensors, are best used for this, wherein other suitable sensor means are not excluded naturally.

Such a sedimentation analysis as detection process may take some minutes. The big advantage of the invention of providing the detecting means with sensors 80 for detecting microfibers in drawer 50 is that this location in the upper part of housing 12 is the location in washing machine 11 with the least amount of vibrations and mechanical interference. Consequently this has been proven to be the best location for not only sedimentation analysis sensors, but also for other sensors that may be used for detecting pollution or microfibers in water. Due to their easy accessibility, the sensors can also easily be cleaned or replaced manually. Furthermore, an advantage of also providing the filter 66 in drawer 50 is that it is also easily and readily accessible there. Apart from drawer 50, a conventional washing machine only has one small opening in a lower area of the body, preferably for completely emptying the water circulation in the washing machine from water. By arranging the filter 66 in the drawer 50 there is no need to change much in the basic construction principle of the washing machine. Cleaning of filter 66 as well as potentially replacing it can be achieved very easily and is comfortable for a user.

For the time that the analysis of water in detecting chamber 79 takes, the water circulation should continue in a conventional manner via circulation pump 33 back into drum housing 16 as fits to the washing process started. It should only be paid attention not to release any water into sewage line 31 out of washing machine that has not been filtered due to potentially containing microfibers. If the result of the analysis of the water is that microfibers are present, and, in particular, with such an amount that a filtering is recommended or mandatory, such filtering will then start. This means that valve device 29 shuts off circulation pipe 33 and directs a flow of water through filter pipe 34 into drawer 50, in particular into filter chamber 65 with the filter 66. Valves 72, 77 and 82 are then opened such that filtered water can flow through the respective chambers into outlet chamber 84 and through siphon outlet 85 via drawer outlet 52 into the drum housing 16 where it continues the washing process.

As an alternative to UV lamp 67, there may be provided means for a bioremediation of fibers, especially of microfibers to destroy them. It is also possible to clean or flush detecting chamber 79 with circulating used water or with water from filter pipe 34 or from fresh water pipe 37, preferably entering into reactor chamber 68, and a corresponding opening and closing of valves 72, 77 and 82.

The start of a filtration of circulating water for microfibers can, if such microfibers have been detected, in each case be initiated by machine control device 40 or, even better, by a receptacle control 54, respectively. In practice, it is regarded as sufficient if water is analyzed a short time span after the washing process of laundry has started, especially one or two minutes after the first rinsing of the laundry with water. It can then be expected that any synthetic fibers in the laundry have set free microfibers that are to be filtered out according to the invention. If such an amount of microfibers has been detected in one washing process, it can obviously be taken that microfibers will be released during the complete washing process, which leads to the filtering being advisable during the complete washing process. In consequence, only water that has passed through the filter 66 may be finally pumped out of the washing machine via sewage line 31, which may pass through drawer 50 and drum 14 as well as pump 27 and valve device 29. Depending on the nature of the filter 66, one filtering step may be sufficient or, alternatively, several filtering steps are needed such that, during an end phase of the washing cycle as well as of the spinning cycle before releasing water out of the washing machine 11, water may be circulated over the filter 66 only for the purpose of filtering before releasing it and not because it is needed for the washing process.

In another option, fresh water from fresh water pipe 37 may be analyzed by a sensor provided in the drawer to be able to determine, for example, content of a contamination or a degree of water hardness. This could also be implemented to analyze grey water coming into the machine before it is let into the drum 14 for a washing process. A rinsing or cleaning of all the sensors 71, 76 and 80 with fresh water may also be used to calibrate them for better accuracy.

In addition to the functional parts for water analysis and water treatment, drawer 50 is provided with a schematically shown receptacle control 54 and a receptacle communication module 56 as mentioned before. This is described in detail later on.

Figure 3:
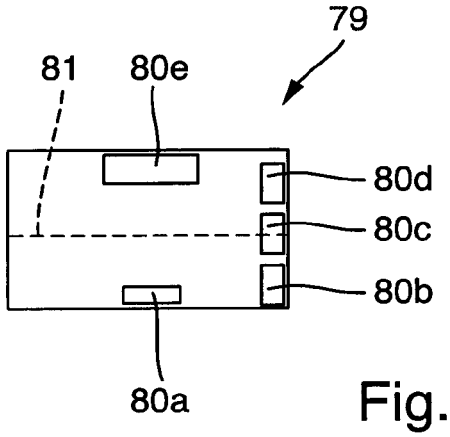
FIG. 3 shows a sectional view from the front side into the drawer of FIG. 2 into a sensor chamber with several sensors.

In FIG. 3, a sectional view through sensor chamber 79 is shown. The rest of receptacle 50 is not shown. In sensor chamber 79, a level of water 81 is schematically shown taking up about half the height of sensor chamber 79. This FIG. 3 shall show some exemplary and various positions of sensors 80 in sensor chamber 79. In a first position, a sensor 80*a* is provided down low in sensor chamber 79, in particular on its floor to be fully immersed in the water 81. This position has the advantage that sensor 80*a* is covered with water 81 in any case to be able to make an analysis also for small volumes of water 81 or for a maximum duration of time.

A second sensor position for sensor 80*b* is shown which is also almost down on the ground of sensor chamber 79, but also placed on a lateral side. Such a position could be more comfortable for an electrical contact to sensor 80*b*, for example through the lateral sidewall of sensor chamber 79.

A third possible sensor 80*c* is shown, also on the lateral sidewall of sensor chamber 79, and partly submersed in the water 81. Sensor 80*c* is about as high as a level of water 81. Together with a fourth position for a sensor 80*d* on the lateral sidewall, but above sensor 80*c*, these three sensors might also serve as level sensors for sensing a water level in sensor chamber 79. Sensor 80*d* is in this case above the level of water 81 and, consequently dry. This need not absolutely be the case, but is for most of the time.

In a fifth position, a sensor 80*e* is placed at a maximum height in sensor chamber 79, which in this case is on an upper lid or upper wall of sensor chamber 79. This sensor 80*e* is supposed to be dry for most of the time, preferably at all times. Sensor 80*e* might be a sedimentation analysis sensor as mentioned at the beginning, which may have a look at a sediment in the water 81 in sensor chamber 79.

Figure 4:
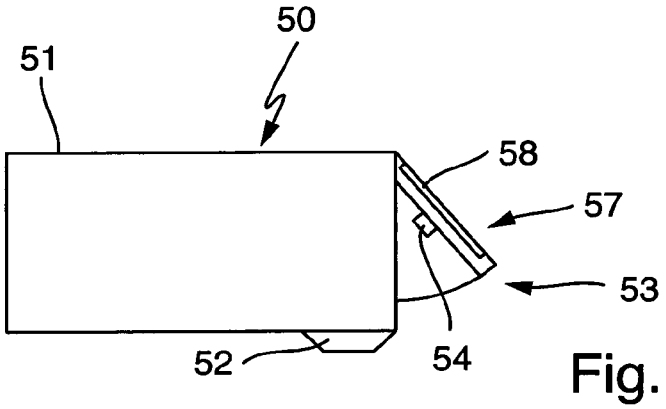
FIG. 4 shows a view from the side onto a first embodiment of the drawer of FIG. 2 with a partial sectional view onto a receptacle control device with a touch screen.

In FIG. 4, a view from the side onto a first embodiment of drawer 50 is shown. Drawer 50 has a drawer body 51, preferably made from synthetic material. Even more preferably, drawer 50 is a construction unit, which means that it is one part. Drawer 50 can be housed in housing 12 of washing machine 11 in conventional manner, especially in slideable manner to be pulled forward from a working position into a filling position. In this filling position, drawer 50 is extracted so far out of housing 12 that at least the detergent chambers 63 are accessible from above for filling in detergents and other additives as described before. It may be possible that drawer 50 can be extracted even more or also be detached from washing machine 11, preferably by unlocking any locking means, such that it can for example be cleaned or replaced or filtered matter from filter 66 can be removed out of filter chamber 65.

In the case of FIG. 4, a front part of drawer 50 has a grip 53 on a lower side for easier extracting. In the part of the front extending above grip 53, receptacle control 54 is placed. Next to receptacle control 54, the receptacle communication module 56 according to FIG. 1 or 2 could be provided, which can easily be imagined and need not be shown in the drawing for sake of simplicity.

Also in this case, as explained with regard to FIG. 1, receptacle communication module 56 is provided for wireless communication with the rest of washing machine 11. Receptacle communication module 56 may also communicate to the outside, for example via WLAN into a wireless net in household and, consequently, to the Internet or to a cloud server in the Internet.

On the front side of drawer 50, above grip 53, a touch screen 58 is provided in the front 57. This touch screen 58 may be of conventional kind and is connected to receptacle control 54 for inputting operation commands by a user and also for outputting information to a user. Such a touch screen 58 provides for a very easy and versatile way to control operation of not only drawer 50 with its function units, but also of the whole washing machine 11.

Figure 5:
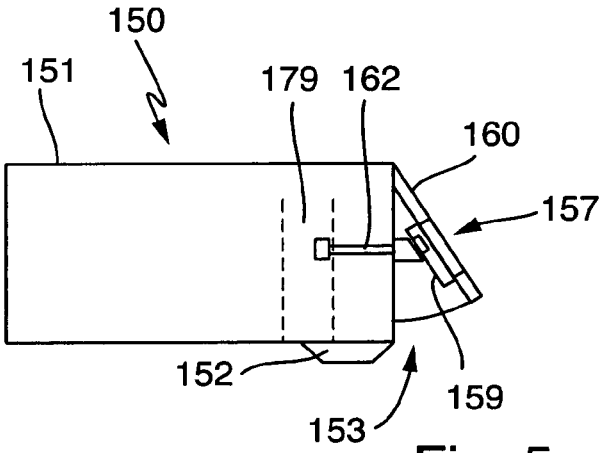
FIG. 5 shows a view from the side onto a second embodiment of the drawer of FIG. 2 with a partial sectional view onto an integrated smartphone with a touch screen as receptacle control device and a light guide into a sensor chamber.
Figure 6:
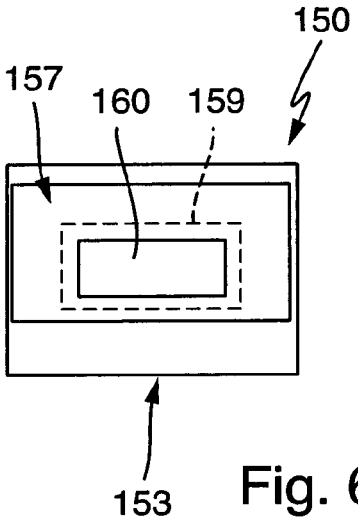
FIG. 6 shows a front view onto the drawer of FIG. 5 with the touch screen of the smartphone.

A view from the side onto a second embodiment of a drawer according to the invention is shown in FIG. 5, whereas FIG. 6 is the respective front view. Drawer 150 is partly similar to drawer 50 of FIG. 4 with the exception that on the front 157 above grip 153 of drawer body 151, a different kind of control device is provided. Whereas in FIG. 4, receptacle control 54 is a part of itself or an independent part, preferably with a powerful controller, in the embodiment of FIGS. 5 and 6 an integral smartphone 159 is provided. Its front screen is placed underneath a front cover 160 in the front 157 such that its touch screen can be operated in the same manner as touch screen 58 in FIG. 4. In one alternative, front cover 160 is not even needed and the touch screen of smartphone 159 itself is open and directly accessible.

On the back side of smartphone 159, very close to its back side camera, optics 162 with a light guide are provided which reach into sensor chamber 179, being schematically shown in dashed lines. This means that one way to make an analysis in sensor chamber 179 is not with internal sensors as described before, but with camera of smartphone 159. This camera may look into sensor chamber 179 via the light guide of the optics 162. These optics 162 may also be provided with mirrors, lenses, prisms and the like. They may serve for looking into sensor chamber 179 in a most positive way. This serves for not only using the camera of smartphone 159 for a simple optical analysis, but potentially also for a spectrometrical analysis or an analysis with infrared light. Another advantage is that the controller in smartphone 159 regularly is very powerful being a very fast processor, and that most modern smartphones have an integrated function for analyzing photos from their camera.

In FIG. 6, the front view onto drawer 150 with front 157 shows protective screen 160 and, behind it in dashed lines, smartphone 159 being placed behind it. This shows that almost the complete touch screen of smartphone 159 may be used.

A power supply for smartphone 159 may either be a direct electrical connection via a cable or via plug-in contacts, as is shown later in FIG. 8. Alternatively, an energy source may be inductive transmission by two coils being arranged very close to each other in the operating position of drawer 50 in washing machine 11, for example at the end of drawer 150 or on a lateral side.

In a preferred alternative embodiment of a drawer very similar to the one of FIGS. 5 and 6, not a complete integral smartphone 159 is provided in drawer 150, but only a part of a conventional smartphone or mobile device. This part preferably is the touch screen of a smartphone together with a main board with its controller or processor, respectively, which is connected to the touch screen. Preferably, such a connection is via a flexible flat connector strip. A rechargeable battery can be provided as well as the camera as mentioned before, which in some cases is also located on a main board of a smartphone. In addition to that, communication hardware may be provided, especially with a Bluetooth communication and a WLAN communication. This means that the GSM module can be left aside as well as some other functions and parts of the conventional smartphone. Any charging port or earphone port as well as a microphone need not be provided resulting in lower costs for the components for a smartphone compared with a complete integral smartphone itself. A loudspeaker may be used for acoustical feedback to a user.

Figure 7:
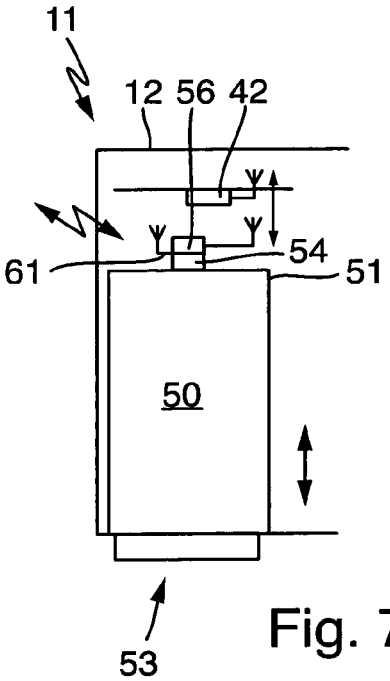
FIG. 7 shows a top view onto a drawer according to FIG. 2 with a plug contact and FIG. 8 shows a top view onto an alternative drawer according to FIG. 2 with wireless communication modules.

In FIG. 7, the view from above onto a drawer 50 similar to the one of FIG. 1 is shown. Drawer 50 is inserted into a holder in the upper left part of washing machine 11 in its housing 12, whereas drawer 50 is significantly longer than conventional drawers. This is explained by all the additional functional units according to FIG. 2.

Drawer 50 has, in this case at its back end compared to FIGS. 4 to 6, receptacle control 54 at its back end having a receptacle communication module 56 with a WLAN antenna 61. This WLAN antenna 61 of receptacle communication module 56 is for communication to the outside as described before. In receptacle control 54, a controller or a processor might be provided as explained before.

Furthermore, receptacle communication module 56 is provided with a Bluetooth antenna being designed to communicate with another Bluetooth antenna of machine side communication module 42. This module 42 is connected to machine control device 40 as explained together with FIG. 1. As the distance between the Bluetooth antennas is not very large, BLE may be implemented advantageously.

If an integral smartphone 159 according to FIG. 5 or at least its essential components are provided on an exemplary drawer, they may preferably be located at a front where grip 53 is situated. A screen is thus visible and accessible for touch inputs. This, however, does not have a negative impact on a Bluetooth communication inside washing machine 11 with machine side communication module 42 and control device 40 in the machine 11.

It is also easy to imagine that on one of the lateral sides of drawer 50 or of drawer body 51, inductive energy transmission coils may be provided. In this way, electrical energy is provided as much as may be needed.

Figure 8:
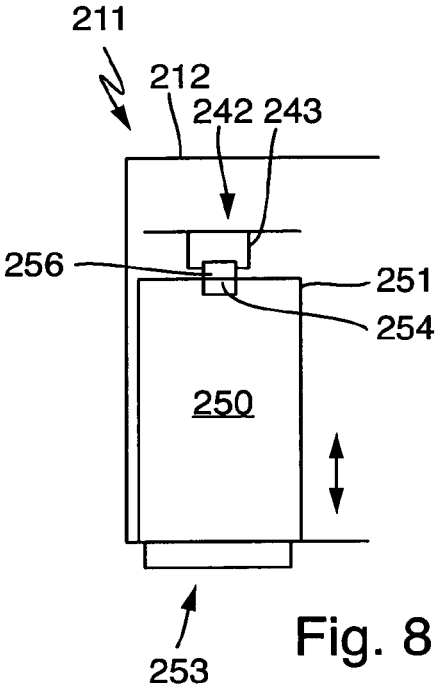

A more simple communication between a receptacle control 254 and a machine control not being shown here can be taken from FIG. 8. In this case, receptacle control 254 is provided with a receptacle communication module 256, in this case being a simple plug. Receptacle communication module 256 is connected to or plugged into a plug contact 243 of machine side communication module 242 forming a direct electrical and galvanic contact. This contact is only closed when the drawer 250 is fully or completely pushed into housing 212 of washing machine 211 in the inserted position. Not only a signal transfer may take place via this plug contact, but also an electrical connection to the sensors and electrical function units in drawer 250 is provided. Furthermore, an energy supply for drawer 250 and receptacle control 254 is provided in a very simple way. Also a battery may be arranged in drawer 250, preferably close to receptacle control 254, for operating at least signalling means, a display or a screen or the like displaying information at the front of drawer 250 where the grip 253 for extracting it is provided.

After various embodiments of the invention have been shown in the figures, especially where a receptacle control and a receptacle communication module may be placed, a person skilled in the art can especially from FIG. 1 take three general constructions and, consequently, embodiments of the invention. This is generally important for the invention and they thus form general inventive concepts being independent from each other. Their features may be valid and characterizing for the invention per se.

In a first general embodiment of the invention, the washing machine is provided with a wireless machine side communication module, preferably via WLAN or Bluetooth, alternatively via a cable connection or a plug connector. Control device of the machine may be provided with a controller or a rather simple microcontroller, respectively. Control device is connected to operating device as well as to a motor control for drive motor. Control device provides for basic control functions and operating modes of washing machine, in particular with regard to drive motor and heater. Control device is also connected to receptacle control, whereas receptacle control is mainly for controlling any sensors in the receptacle as well as evaluating their signals and/or controlling an analysis procedure. Receptacle control may send any data or information to control device which then again controls the respective internal operation of washing machine, for example for directing a water flow of a water circulation in washing machine over filter in the receptacle if microfibers from synthetic materials have been detected in the water. Above all, the operation of the sensors in the receptacle is controlled and their data may be analyzed for sending respective information to control device. In this case, control device and receptacle control may have similar powerful controllers.

In a variation of this first general embodiment, the receptacle with receptacle control does not have any controller at all except one exclusively in receptacle communication module. The intelligence is then located in the washing machine outside the receptacle. The receptacle only is provided with sensors and function units, as has for example been described with regard to FIG. 2.

In a second general embodiment of the invention, controller of receptacle control is rather powerful. Control device does only have a very simple controller. In motor control, a simple controller is provided, which only receives information about a power for drive motor, wherein an inverter or a power converter in motor control supply power to drive motor respectively. Also heater may be controlled by motor control, for example by simply switching heater on or off, for example with a relay.

In a variation of this second general embodiment, control device does have no controller at all.

In control device, consequently, only very little or no intelligence is provided except for machine side communication module, being thus connected to motor control. In this second embodiment, the intelligence or the brain is mainly located in the receptacle or in the receptacle control, respectively. This has the main advantage that by simply exchanging receptacle with a different version or one, preferably, with a more powerful controller, the rest of the machine can be used further on. Generally, a life cycle for a washing machine is about ten to fifteen years, which is rather long. For a respective control, this may be significantly shorter. In this case, it is very advantageous to not only have a more powerful brain or controller in the receptacle, but also new ways for analyzing water and/or filtering water, preferably from microfibers, by exchanging a controller or the receptacle. This allows for greatly enhancing the potential and capabilities of a washing machine by simply exchanging its receptacle which only needs to have a communication with the washing machine.

In a third general embodiment of the invention, an integral mobile device such as a smartphone or a part of such a mobile device is provided in the receptacle. Also in this case, a major part of the intelligence or, preferably, all the intelligence is located in the receptacle. In washing machine, control device need not have many functionalities or power, basically also because a processor used in a smartphone is by far more capable than any processor or controller used in a washing machine.

Another advantage of using an integral mobile device or at least a processor or controller of a smartphone in drawer 50 is that, in the arrangement of FIGS. 5 and 6, the implementing of the touch screen of the smartphone in the front 57 of drawer 50 provides for very easy operation of the washing machine and/or the sensors. The touch screen is cooperating perfectly with a corresponding processor. Having its own operating system, preferably Android or iOS. Any new programs or functions for washing machine 11 may be in the form of so-called Apps in the mobile device or its controller, respectively. Programming of such Apps is much easier than programming of a general controller for a household device in machine code.

The provision of a motor control 19 with some kind of small controller has the advantage that a conventional and standard configuration of a washing machine may be used, also with regard to safety regulations. Also case it is not necessary in this to re-program a new kind of motor control together with a control of heater 21, where a given and reliable concept is present and may advantageously be used.

The invention claimed is:

1. Washing machine receptacle (50, 150, 250) comprising:

a receptacle body (51, 151, 251) having several chambers including chambers (63) for filling in detergents or additives for a washing process in the washing machine (11, 211), sensor means (71, 76, 80) in the receptacle for analyzing water transported to the sensor means, and a receptacle communication module (56, 160, 256) in or on the receptacle, the receptacle communication module being configured to provide a data connection to at least one component out of the receptacle.

2. Washing machine receptacle according to claim 1, wherein the receptacle communication module (56, 160) for the data connection provides a wireless data connection.

3. Washing machine receptacle according to claim 1, wherein the receptacle communication module (256) for the data connection to the outside is designed to be with a direct electrical connection.

4. Washing machine receptacle according claim 1, wherein the receptacle (50) is provided with a receptacle control device (54, 254) with a controller for controlling the sensor means (71, 76, 80) and for processing data of the sensor means.

5. Washing machine receptacle according to claim 4, wherein the receptacle control device (54, 254) has a sensor controller of its own for analyzing and/or processing data of the sensor means (71, 76, 80).

6. Washing machine receptacle according to claim 1, wherein either a receptacle control device (54, 254) or a sensor controller is connected to a database for supporting the analyzing process and/or for reporting information from the analyzing process of the sensor means, the database being in a cloud connected to via internet.

7. Washing machine receptacle according to claim 1, wherein operating elements (58, 159) configured for influencing operation of functional units of the receptacle (50, 150) are provided on the receptacle.

8. Washing machine receptacle according to claim 7, wherein the operating elements (58, 159) are configured for operation of the washing machine (11) and provided on the receptacle (50) with the exception of only a main switch (49) for the washing machine (1 1) being provided outside of the receptacle or separate from the receptacle.

9. Washing machine receptacle according to claim 1, wherein on the receptacle display means (58, 159) are provided.

10. Washing machine receptacle according to claim 1 wherein the receptacle (150) is provided with components of a smartphone (159), at least a display and a main control board, wherein the components are connected to a receptacle control device (54, 254), and wherein the components of the smartphone (159) are arranged in the receptacle (150) such that the display of the smartphone (159) is visible from the outside.

11. Washing machine receptacle according to claim 1, wherein the receptacle (150) is provided with an integral smartphone (159), wherein the integral smartphone (159) is connected to a receptacle control device (54, 254), and wherein the integral smartphone (159) is arranged in the receptacle (150) such that a display of the integral smartphone (159) is visible from the outside.

12. Washing machine receptacle according to claim 10, wherein a camera or an optical sensor is provided as a component of the smartphone (159), wherein the camera or the optical sensor is directed into the receptacle (50) and into a chamber (79) in the receptacle body and configured for an optical analysis in the chamber (79), wherein optical guide means are provided to guide light beams between the chamber (79) and the camera or the optical sensor.

13. Washing machine receptacle according to claim 10, wherein a part of or the smartphone (159) is the receptacle control device with a microcontroller of the part of or the smartphone being designed for performing the respective control functions of the receptacle control device.

14. Washing machine receptacle according to claim 1, wherein at least one sensor chamber (68, 74, 79) with the sensor means (71, 76, 80) is provided in the receptacle (50) for being filled with water (81) from the drum (14) of the washing machine (1 1) for analyzing this water.

15. Washing machine receptacle according to claim 1, wherein the sensor means (71, 76, 80) have at least one sensor for analyzing water (81) from the drum (14), wherein the sensors are from the group of pH-sensors, temperature sensors, Bio sensors for bacteriological pollution, optical sensors, opacimeter sensors, spectrometer sensors, color change indicator sensors, tenside sensors, sedimentation analysis sensors, or any combination of these.

16. Washing machine receptacle according to claim 1, wherein, in the receptacle (50), an activating means (69) is provided for treating special detergents or special additives (70) for the washing process, wherein the special detergents or special additives (70) are configured to be activated by the activation means by mechanical treatment, chemical treatment, heat activation (69), microwave radiation or UV radiation.

17. Washing machine receptacle according to claim 1, wherein the receptacle (50, 150, 250) is at least partly movable or retractable out of a housing (12, 212) of the washing machine (11, 211).

18. Washing machine receptacle according to claim 1, wherein the receptacle (50) has at least three separate chambers (63, 65, 68, 74, 79, 84), wherein there is provided a filtering means (66) in a filtering chamber (65), at least one sensor chamber (68, 74, 79) with a sensor means (71, 76, 80) and an outlet (52, 85) out of the receptacle or a drainage of the receptacle.

19. Washing machine receptacle according to claim 1, wherein an independent and/or replaceable energy source is provided in the receptacle.

20. Washing machine receptacle according to claim 1, wherein the receptacle is provided with a wireless connection to an energy source.

21. A washing machine (11, 211) for use with a washing machine receptacle (50, 150, 250) according to claim 1, the washing machine comprising:

a housing (12, 212), a drum (14) in a drum housing (16) in the housing for conducting a washing process therein, a sump (24) located underneath the drum for collecting water exiting the drum, —a water circulation (23), a circulation pump (27) for circulating water in the water circulation and pipes (25, 28, 33, 34) for connecting these components, a dispensing system (38) configured to supply to the drum (14) detergents, additives or chemicals for the washing process, the dispensing system being configured to have the washing machine receptacle (50) included therein, a separate water duct (34) for water from the drum (14) to be transported into the dispensing system (38), and a machine side communication module (42, 243) in the washing machine (11, 211) for communication with the receptacle (50, 250) or with a receptacle side communication module (56, 256).

22. Washing machine according to claim 21, wherein it has a control device (40) for the washing machine (11) being adapted for controlling water heating (21) and drum rotation (18), this control device (40) having the machine side communication module (42, 243) for communication with the receptacle communication module (56, 256), wherein there is a receptacle control device (54, 254) in the receptacle (50, 250) being connected with the receptacle communication module (56, 256).

23. Washing machine according to claim 21, wherein the washing machine has no other control device than at least one of the group of: in the machine side communication module for communication with the receptacle communication module, and a motor control.

24. Washing machine according to claim 21, wherein a valve (29) is placed behind the circulation pump (27), wherein a valve outlet is connected to the separate water duct (34) to the dispensing system (38).

25. Washing machine according to claim 21, wherein the washing machine (11, 211) is provided with a washing machine receptacle (50, 150, 250), the receptacle being located at a higher level than a center point of the drum (14).

26. Washing machine according to claim 25, wherein the receptacle control device (54, 254) is connected to a motor control for a drive motor (18) of the drum (14), the motor control being located in the washing machine (11, 211), wherein the receptacle control device (54, 254) is the only control device of the washing machine, and wherein the at least one controller in the receptacle control device (54, 254) is the only controller in the washing machine.

27. Method for operating a washing machine according to claim 21, wherein the water transported in the washing machine (11, 211) to the receptacle (50, 250) is analyzed by the sensor means (71, 76, 80) in the receptacle.

28. Method for operating a washing machine according to claim 27, wherein the washing machine (11, 211) is connected to the internet or to a cloud server by:

one or more of: receiving action information from the cloud to control a function unit of the washing machine, or forwarding information from the washing machine to the cloud, wherein the cloud server is configured to communicate with a plurality of home appliances and/or to provide to the washing machine energy cost information as action information and/or to provide water quality information as action information and/or to provide advertisement information regarding the washing machine.

29. Method for operating a washing machine according to claim 28 with a receptacle, wherein a the part of a smartphone (159) or an integral smartphone is connected to the internet or to the cloud server and transmits data into the washing machine (11, 211) concerning operating parameters of the washing machine.

* * * * *